US005354025A

United States Patent [19]

McCaffrey

[11] Patent Number: 5,354,025

[45] Date of Patent: Oct. 11, 1994

[54] FURNITURE SHELF SUPPORT BRACKET

[75] Inventor: Jeffrey T. McCaffrey, Portland, Oreg.

[73] Assignee: Anthro Corporation, Portland, Oreg.

[21] Appl. No.: 991,063

[22] Filed: Dec. 15, 1992

[51] Int. Cl.[5] ..... A47G 29/00

[52] U.S. Cl. ..... 248/188; 108/156; 211/187; 248/235; 248/250

[58] Field of Search ..... 248/188, 188.1, 235, 248/250; 211/187; 108/154, 155, 156, 157, 111, 101

[56] References Cited

U.S. PATENT DOCUMENTS

| | | | |
|---|---|---|---|
| 1,645,421 | 10/1927 | Gloekler | 248/188 |
| 3,510,096 | 5/1970 | Mutchnik et al. | 248/188 |
| 3,874,511 | 4/1975 | Maslow | 108/156 X |
| 4,120,250 | 10/1978 | Viessmann | 211/187 X |
| 4,237,798 | 12/1980 | Welsch et al. | 248/188 X |
| 4,615,278 | 10/1986 | Cabrelli | 248/188 X |
| 4,637,323 | 1/1987 | Nicely | 211/187 X |
| 4,750,626 | 6/1988 | Nicely | 211/187 |
| 4,799,643 | 1/1989 | Shepard | 248/250 X |
| 4,852,837 | 8/1989 | Merten et al. | 248/188 |
| 4,892,044 | 1/1990 | Welsch | 211/187 X |
| 5,148,928 | 9/1992 | Arnold | 211/187 |

*Primary Examiner*—Ramon O. Ramirez
*Assistant Examiner*—Derek J. Berger
*Attorney, Agent, or Firm*—Stoel Rives Boley Jones & Grey

[57] ABSTRACT

The present invention includes a furniture shelf support bracket for supporting a furniture shelf and connecting it to a vertical furniture member such as, for example, a cylindrical vertical tube. In a preferred embodiment, the support bracket includes a semicylindrical cuff with an inner surface for engaging the vertical tube and an outer surface from which a platform projects for engaging a bottom surface of the shelf. A pair of alignment ridges are positioned on an upper surface of and extends along the platform, and a lip extending from a marginal edge of the outer surface of the cuff for engaging a top surface and side edge of the shelf. The alignment ridges fit within an alignment slot in the bottom surface of the shelf and engage a clamping plate set into a clamping slot that intersects and is transverse to the alignment slot.

13 Claims, 3 Drawing Sheets

FURNITURE SHELF SUPPORT BRACKET

TECHNICAL FIELD

The present invention relates to furniture shelves and, in particular, to brackets for supporting such shelves.

BACKGROUND OF THE INVENTION

FIG. 1 is a fragmentary isometric view showing a prior art support bracket 10 that is connectable to a cylindrical vertical tube 12 for supporting a shelf 14 of a table, desk, stand, or cart. Shelf 14 may function as a primary table top, work surface, or storage surface, or as one of several such surfaces. Typically, one support bracket 10 would be used on each of three or four vertical tubes 12 to support shelf 14.

Support bracket 10 includes a semicylindrical cuff 16 with an outer surface 18 from which a flat, generally rectangular platform 20 projects. A prop 22 extends from outer surface 18 to a bottom surface 24 of platform 20. Support bracket 10 is typically formed as a unitary article of injection-molded plastic.

To support shelf 14, outer surface 18 of cuff 16 is set in and secured to a semicircular notch 26 in a side margin of shelf 14 and platform 20 is set against a bottom surface 28 of shelf 14. In particular, support bracket 10 is secured to shelf 14 by several heavy-duty staples, some of which are driven through a recess 29 in cuff 16 and others of which are driven through platform 20. Notch 26 is precisely cut, particularly at its outer edges 30*a* and 30*b*, to form a precise, finished-looking fit with cuff 16. Support bracket 10 is then attached to vertical tube 12 by a screw 32 that passes through a preformed hole (not shown) near prop 22.

Although support bracket 10 provides acceptable support for shelf 14, assembling support bracket 10 and shelf 14 can be relatively time-consuming and difficult. In particular, shelf 14 is typically formed mainly of particle board with an extruded vinyl edge trim 34. Notch 26 is difficult to form precisely in such a combination of materials because edge trim 34 is relatively pliable and tends to deform when being cut, thereby resulting in a slightly irregular edge. In addition, setting semicylindrical cuff 16 within semicircular notch 26 can be difficult because of the ease of rotational motion between them. As a consequence, the manufacture of furniture employing support bracket 10 suffers from relatively low productivity.

Such assembly techniques are typically performed by the manufacturer and require that shelf 14 be shipped to customers with support brackets 10 attached thereto. A consequence is that support brackets 10 are susceptible to damage during shipment and require replacement of the combined shelf 14 and support brackets 10 when damage occurs. This susceptibility to damage and requirement that a shelf be replaced with support brackets 10 results in relatively high damage replacement costs.

SUMMARY OF THE INVENTION

An object of the present invention is, therefore, to provide a support bracket that supports furniture shelves and is simple to use relatively quickly.

Another object of this invention is to provide such a support bracket that provides a finished-looking fit despite minor imprecision in the finish of a supported shelf.

A further object of this invention is to provide such a support bracket that provides improved productivity in the manufacture of furniture.

Still another object of this invention is to provide such a support bracket that may be attached to a furniture shelf by a consumer to reduce manufacturing and shipping damage costs.

The present invention includes a support bracket for supporting a furniture shelf and connecting it to a vertical furniture member such as, for example, a cylindrical vertical tube. In a preferred embodiment, the support bracket includes a semicylindrical cuff with an inner surface for engaging the vertical tube and an outer surface from which a platform projects for engaging a bottom surface of the shelf.

A pair of alignment ridges are positioned on an upper surface of and extends along the platform, and a lip extends from a marginal edge of the outer surface of the cuff for engaging a top surface and side edge of the shelf. The alignment ridges fit within an alignment slot in the bottom surface of the shelf and engage a clamping plate set into a clamping slot that intersects and is transverse to the alignment slot. A screw connecting the support bracket and clamping plate to secure them as a support assembly to the shelf.

The alignment ridges and lip cooperate to make the support bracket of this invention simple to use while providing a finished-looking fit despite the minor imprecision in the finish of the shelf, thereby improving the productivity in the manufacture of such furniture. More specifically, the lip functions to cover imprecise cuts in the shelf or edge trim so that these cuts may be made faster. The alignment ridges prevent rotational movement between the support bracket and the notch so that slippage between them is eliminated. As a result, the support bracket of this invention may be attached to a shelf by a consumer and thereby reduce manufacturing and shipping damage costs.

Additional objects and advantages of the present invention will be apparent from the detailed description of the preferred embodiment thereof, which proceeds with reference to the accompanying drawings.

DETAILED DESCRIPTION OF PREFERRED EMBODIMENT

Figure 1:
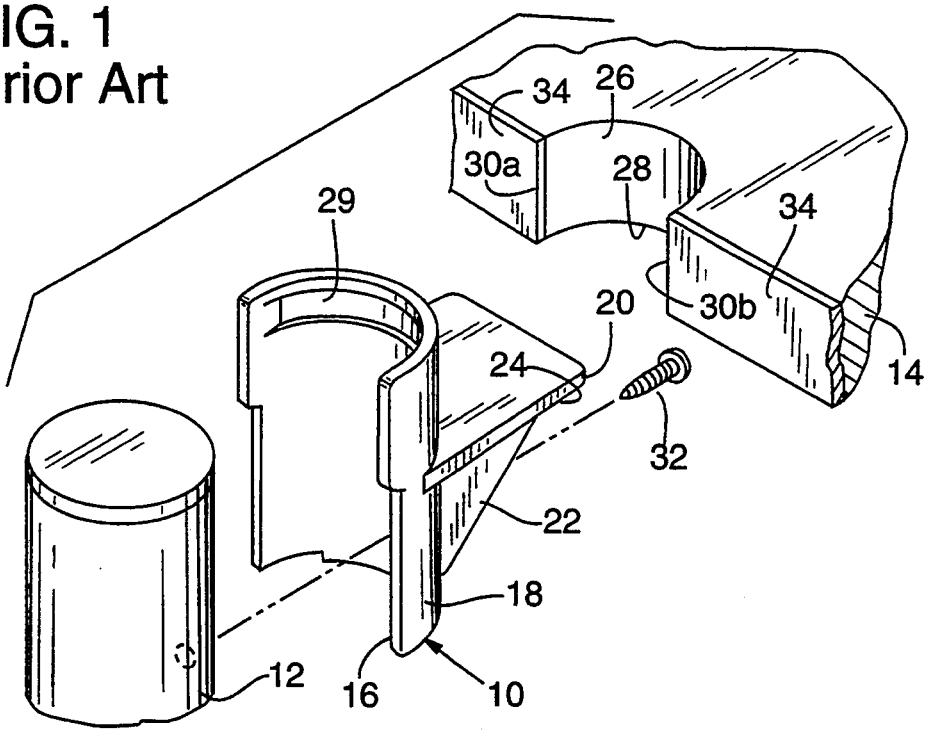
FIG. 1 Prior Art
FIG. 1 is a fragmentary exploded isometric view of a furniture shelf with a prior art support bracket for attaching the shelf to a vertical tube.
Figure 2:
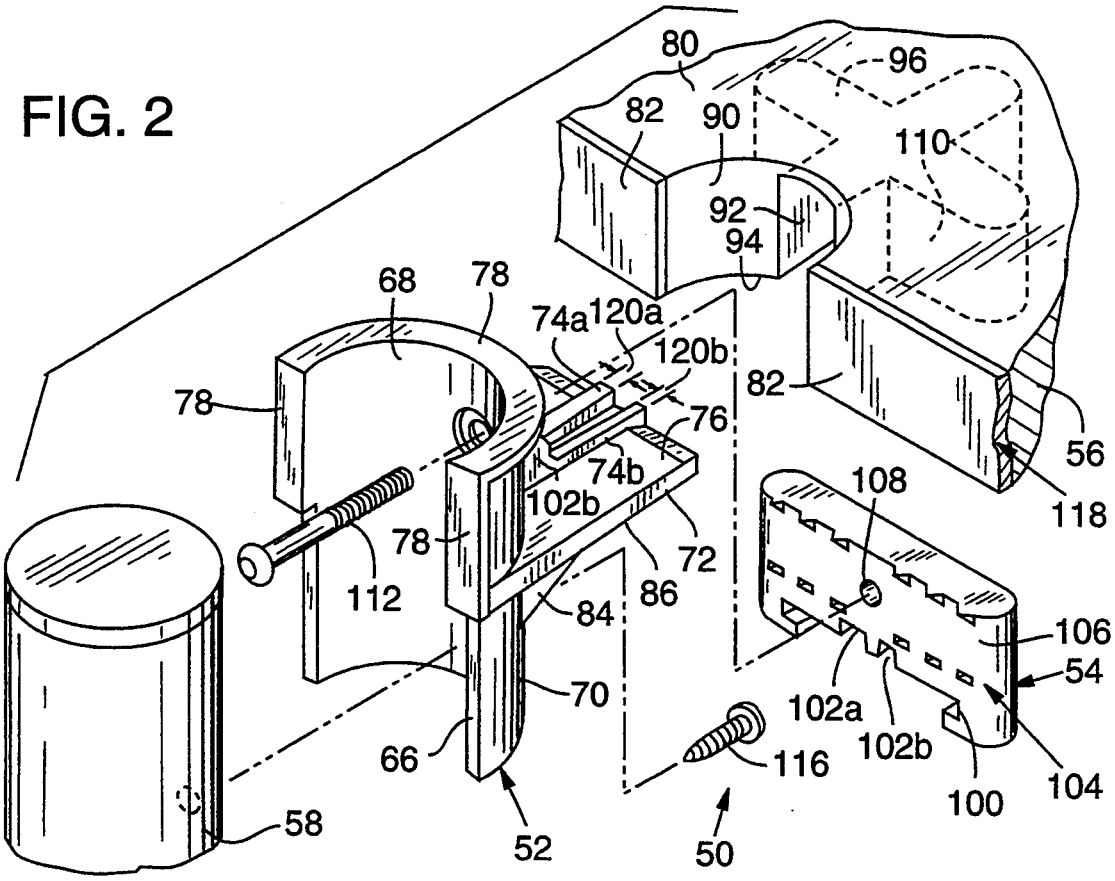
FIG. 2 is a fragmentary exploded isometric view of a cart or table shelf with a support bracket and a clamp plate of the present invention.
Figure 3:
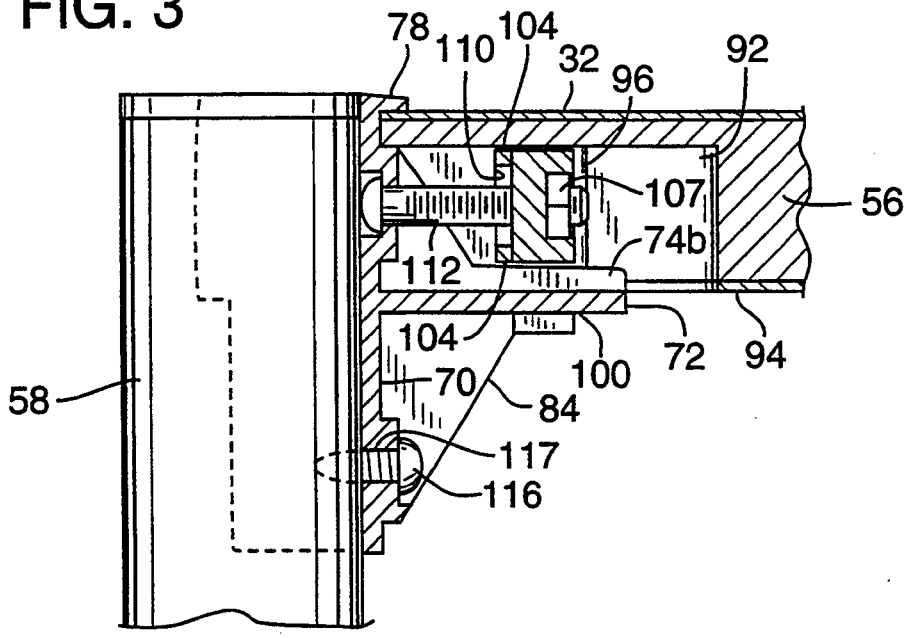
FIG. 3 is a fragmentary sectional side view of a shelf attached to a vertical support tube by the support bracket and clamp plate.
Figure 4:
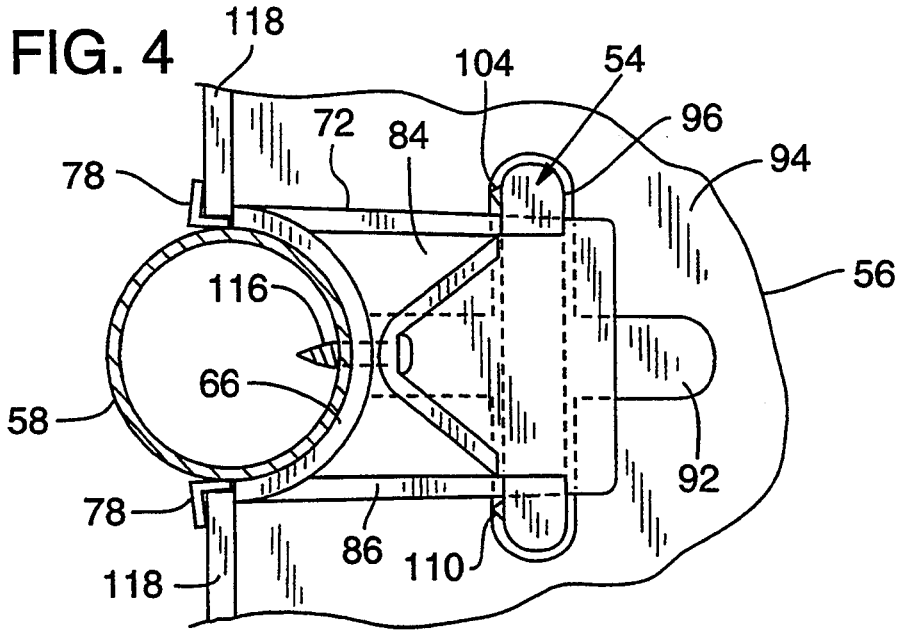
FIG. 4 is a bottom plan view of the assembled support bracket and clamp plate.

FIGS. 2–4 show a support assembly 50, having a support bracket 52 and a clamping plate 54, for coupling a shelf 56 to a vertical member or tube 58 of a piece of furniture such as a table, desk, stand, or cart. Vertical tube 58 is preferably cylindrical and shelf 56 may function as a primary table top, work surface or storage surface or as one of several such surfaces. Typically, one support assembly 50 would be used on each of at least two vertical tubes 58 to support shelf 56, as shown in U.S. Pat. No. Des. 328,209 of Knaub et al.

Figure 5:
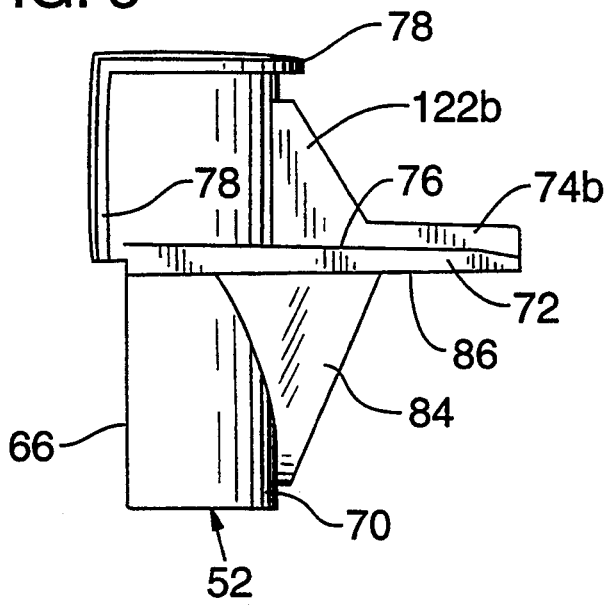
FIG. 5 is a side elevation view of the support bracket of this invention.
Figure 6:
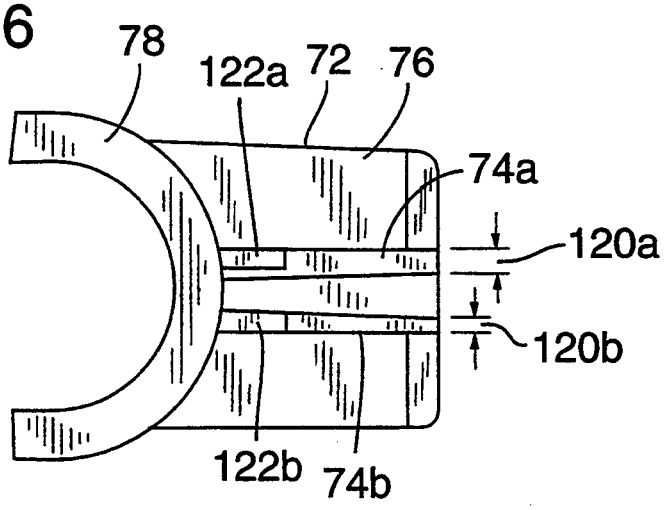
FIG. 6 is a top plan view of the support bracket of this invention.

Referring also to FIGS. 5 and 6, support bracket 52 includes a semicylindrical cuff 66 with an inner surface 68 for engaging vertical tube 58 and an outer surface 70 from which a generally rectangular platform 72 projects. A pair of alignment ridges 74*a* and 74*b* are positioned on and extend along an upper surface 76 of platform 72. A lip 78 extends from an upper marginal edge of outer surface 70 for engaging a top surface 80 and a side edge 82 of shelf 56. A prop 84 is positioned between outer surface 70 and a lower surface 86 of platform 72. Support bracket 52 is typically formed as a unitary article of injection-molded plastic such as polycarbonate.

For each support bracket 52, shelf 56 includes a semicircular notch 90 in a side margin, an alignment slot 92 set in a bottom surface 94 and extending from notch 90, and a transverse slot 96 that intersects alignment slot 94 and is preferably perpendicular to it. Clamping plate 54 includes a groove 100 along a bottom edge 102 and a pair of recesses 102*a* and 102*b* within groove 100. Multiple teeth 104 project from a front face 106, and a threaded nut 107 (FIG. 3) is axially aligned with an aperture 108 in clamping plate 54.

To attach support assembly 50 to shelf 56, clamping plate 54 is set into slot 96 with teeth 104 facing notch 90 and engaging a surface 110 of slot 96. Outer surface 70 of cuff 66 is set into notch 90 such that platform 72 engages bottom surface 94 and fits into groove 100 of clamping plate 54, alignment ridges 74*a* and 74*b* extend through slot 92 into respective recesses 102*a* and 102*b*, and lip 78 engages top surface 80 and side edge 82 of shelf 56. A screw 112 passes through an aperture 114 in support bracket 52 to nut 94 and it tightened to secure support assembly 50 to shelf 56. Support assembly 50 is then attached to vertical tube 58 by a screw 116 that passes through a second aperture 117 to tube 58.

Alignment ridges 74*a* and 74*b* and lip 78 cooperate to make the support bracket 52 simple to use while providing a finished-looking fit despite minor imprecision in the shape of notch 90, thereby improving the productivity in the manufacture of furniture. More specifically, lip 78 functions to cover an imprecisely cut notch 90, particularly in a vinyl edge trim 118 that extends around shelf 56. As a result, these cuts may be made much faster. Alignment ridges 74*a* and 74*b* prevent rotational movement between support bracket 52 and notch 90 so that slippage between them is eliminated and assembly is simplified so that it can be performed by a consumer.

To further facilitate assembly by a consumer, alignment ridges 74*a* and 74*b* may b formed with different widths 120*a* and 120*b* to match those of recesses 102*a* and 102*b*, respectively. Such alignment ridges 74*a* and 74*b* assure that support assembly 50 is assembled correctly with clamping plate 54 facing support block 52. Similarly, alignment ridges 74*a* and 74*b* include respective buttresses 122*a* and 122*b* to strengthen support bracket 52.

It will be obvious to those having skill in the art that many changes may be made in the above-described details of the preferred embodiment of the present invention without departing from the underlying principles thereof. For example, cuff 66 of support bracket 52 has a semicylindrical shape to match the preferred cylindrical shape of vertical tube 58. However, support brackets of the present invention could include cuffs of other semi-tubular shapes to match vertical tubes having noncircular cross-sections, such as any of various polygons. The scope of the invention should, therefore, be determined only by the following claims.

I claim:

1. A combination furniture shelf and furniture shelf support bracket for supporting the furniture shelf and connecting it to a vertical furniture member, comprising:

a furniture shelf support bracket having a semi-tubular cuff with an upper marginal edge, an inner surface for engaging the vertical furniture member, an outer surface from which a platform projects, a first alignment ridge centrally positioned on an upper surface of and extending along the platform, and a top lip extending from the upper marginal edge of the outer surface of the cuff, the platform and the top lip extending from the outer surface of the cuff by respective first and second distances, the first distance being substantially greater than the second distance; and a furniture shelf having side edges that extend between corners, a slot in a side edge apart from a corner of the furniture shelf into which slot the first alignment ridge fits, and a top surface and a bottom surface that are engaged by the top lip and the platform, respectively.

2. The combination of claim 1 in which the outer surface of the semi-tubular cuff further comprises side marginal edges and first and second side lips extending from the side marginal edges for engaging the side edge of the furniture shelf.

3. The combination of claim 1 in which the semi-tubular cuff further comprises a second alignment ridge positioned next and substantially parallel to the first alignment ridge and the first and second alignment ridges fit into the slot in the side edge of the furniture shelf.

4. The combination of claim 3 in which the first and second alignment ridges have different first and second widths, respectively.

5. A combination furniture shelf and furniture shelf support assembly for supporting the furniture shelf and connecting it to a vertical furniture member, comprising:

a support bracket having a semi-tubular cuff with an inner surface for engaging the vertical furniture member, an outer surface from which a platform projects, and a first alignment ridge centrally positioned along an upper surface of the platform;

a clamping plate positionable transverse to the first alignment ridge;

coupling means for coupling the support bracket and the clamping plate; and a furniture shelf having a bottom surface that is engaged by the upper surface of the platform, a first slot into which the first alignment ridge is positionable, and a second shelf in the bottom surface of the furniture shelf into which second slot the clamping plate is positionable, the second slot being transverse to the first slot to orient the clamping plate transverse to the first alignment ridge.

6. The combination of claim 5 in which the clamping plate includes a first recess for receiving the first alignment ridge of the support bracket.

7. The combination of claim 5 in which the clamping plate includes a platform recess for receiving the platform of the support bracket.

8. The combination of claim 5 in which the semi-tubular cuff includes an upper marginal edge from which a lip extends to engage a top surface of the furniture shelf and the platform and lip of the support bracket extend from the outer surface of the cuff by respective first and second distances, the first distance being substantially greater than the second distance.

9. The combination of claim 5 in which the furniture shelf includes a side edge along which the support bracket is positionable and the outer surface of the semi-tubular cuff includes side marginal edges from which first and second side lips extend for engaging the side edge of the furniture shelf.

10. The combination of claim 5 in which the furniture shelf includes side edges that extend between corners and the semi-tubular cuff engages the furniture shelf along a side edge apart from a corner of the furniture shelf.

11. The combination of claim 5 in which the support bracket further comprises a second alignment ridge positioned next and substantially parallel to the first alignment ridge and the first and second alignment ridges fit into the first slot in the furniture shelf.

12. The combination of claim 11 in which the clamping plate includes first and second recesses for receiving the respective first and second alignment ridges.

13. The combination of claim 12 in which the first alignment ridge and first recess are of different widths than the second alignment ridge and second recess.

* * * * *